US012721410B1

(12) United States Patent
Rivera

(10) Patent No.: US 12,721,410 B1
(45) Date of Patent: Sep. 1, 2026

(54) ORGANIZING TRAY

(71) Applicant: Dawilki Rivera, Newark, NJ (US)

(72) Inventor: Dawilki Rivera, Newark, NJ (US)

( * ) Notice: Subject to any disclaimer, the term of this patent is extended or adjusted under 35 U.S.C. 154(b) by 120 days.

(21) Appl. No.: 17/714,932

(22) Filed: Apr. 6, 2022

Related U.S. Application Data

(63) Continuation-in-part of application No. 16/912,906, filed on Jun. 26, 2020, now abandoned.

(51) Int. Cl.

| | |
|---|---|
| ***A45C 13/02*** | (2006.01) |
| ***A45C 13/04*** | (2006.01) |
| ***A45F 3/00*** | (2006.01) |
| ***A45F 3/04*** | (2006.01) |

(52) U.S. Cl.
CPC ..... *A45C 13/02* (2013.01); *A45C 13/04* (2013.01); *A45F 3/04* (2013.01); *A45C 2013/026* (2013.01); *A45F 2003/001* (2013.01)

(58) Field of Classification Search
CPC ... A45C 13/02; A45C 13/04; A45C 2013/026; A45F 3/04; A45F 2003/001
USPC ..... 190/110
See application file for complete search history.

(56) References Cited

U.S. PATENT DOCUMENTS 2,017,485 A * 10/1935 Yawman ..... B25H 3/023 312/328
3,410,018 A * 11/1968 Woolworth ..... A01K 97/06 206/315.11
3,837,560 A * 9/1974 Kuchuris ..... B26D 3/006 428/116
4,506,769 A * 3/1985 Franco ..... A45C 13/02 190/110
5,358,100 A * 10/1994 Wolff ..... A45C 5/005 206/823
2006/0213736 A1* 9/2006 Godshaw ..... A45C 13/02 190/110
2014/0158737 A1* 6/2014 Koutouras ..... A45F 3/04 224/653
2014/0165450 A1* 6/2014 London ..... A01K 97/06 43/54.1

* cited by examiner

*Primary Examiner* — Nathan J Jenness
*Assistant Examiner* — Jessica Kavini Tamil
(74) *Attorney, Agent, or Firm* — QuickPatents; Kevin Prince

(57) ABSTRACT

An organizing tray for a case that has a storage compartment includes a frame having a perimeter wall that is comprised of at least four frame members. One or more rectangular trays each comprise a bottom wall and a tray perimeter wall. Two pairs of pivotable extensions members for each tray are included for moving the tray from a lowered position to a raised position away from the frame. One or more tray cross members each have two opposing ends. An inside surface of the tray perimeter wall of each tray, and each tray cross member, includes a plurality of parallel recessed slots, each adapted to receive one of the ends of one of the tray cross members. As such, the tray cross members may be fitted into the recessed slots of the tray peripheral wall or another of the tray cross members to divide the tray into multiple sub-compartments.

19 Claims, 5 Drawing Sheets

ORGANIZING TRAY

CROSS-REFERENCE TO RELATED APPLICATIONS

This application is a Continuation-in-Part of U.S. Utility patent application Ser. No. 16/912,906, filed on Jun. 26, 2020, and is incorporated herein by reference.

STATEMENT REGARDING FEDERALLY SPONSORED RESEARCH AND DEVELOPMENT

Not Applicable.

FIELD OF THE INVENTION

This invention relates to cases and luggage, and more particularly to a removable organizing tray for cases or luggage.

BACKGROUND

Luggage, personal and overnight bags, backpacks, convertible utility bags, and the like typically include large compartments that do not help a person organize items stored therein. People in many industries who travel for business, and people who travel recreationally, often have multiple disparate items that, if jumbled all together, are easily lost or damaged. For example, a person traveling with a complex make-up bag might have dozens or even hundreds of different nail polish bottles, lipstick containers, eyeliner containers, or the like.

Several bags, luggage pieces, and backpacks exist with built-in organizing trays. Such trays are not removable, however, in such a way that they can be transferred from a backpack to a piece of luggage easily, maintaining the organization of the items held therein. Further, such built-in organizing trays are typically not expandible in a way to facilitate quick use thereof when the bag or luggage is opened, nor are they easily customizable to create various sizes of sub-compartments within the organizing trays.

Therefore, there is a need for a device that can be moved from different bags, luggage pieces, backpacks, or the like. Such a needed invention would including expandable organizer trays that are easily customizable to create varying sized sub-compartments within the tray. Such a needed device would be relatively inexpensive to manufacture and have relatively few parts, yet still be versatile in its uses. The present invention accomplishes these objectives.

SUMMARY OF THE INVENTION

The present device is an organizing tray for a case that has a storage compartment. The case may be a briefcase, a suitcase, or the like.

A frame has a perimeter wall that is comprised of at least four frame members, each of which have an inside surface and an outside surface. At least two of the frame members are parallel, and preferably the frame takes a rectangular shape with two sets of parallel opposing frame members. The frame is adapted to fit within the storage compartment of the case, and can be made of various sizes corresponding with the size of any particular storage compartment of the case. The frame further includes one or more cross members that extend between the inside surfaces of at least two of the opposing frame members.

One or more rectangular trays each comprise a bottom wall and a tray perimeter wall that has at least four tray walls, each extending upwardly form the bottom wall. The tray walls together with the bottom wall define a large tray compartment therein. Each tray wall has an inside surface and an outside surface.

Two pairs of extensions members for each tray are included for moving the tray from a lowered position to a raised position away from the frame. Each extension member has a lower end pivotally fixed with one of the at least two parallel frame members of the frame, preferably at the inside surface of the frame members. An upper end of each extension member is pivotally fixed with the outside surface of one of the tray walls. The extension members of each pair of extension members are preferably parallel and laterally offset from each other.

The trays, when in the lowered position, together are collapsed to within a projection of the perimeter wall of the frame; that is to say, the trays when in the lowered position do not extend outwardly beyond the perimeter wall of the frame but instead rest above the cross members of the frame. When in the lowered position, the extension members of each pair of extension members remain parallel with each other and nearly or actually in mutual contact.

Preferably the organizing tray further includes one or more tray cross members each having two opposing ends. The inside surface of the tray perimeter wall of each tray includes a plurality of parallel recessed slots. Each recessed slot is adapted to receive one of the ends of one of the tray cross members. As such, with the one or more tray cross members fitted into two opposing recessed slots of the tray perimeter wall, the tray compartment is divided into at least two sub-compartments.

Preferably one or more of the tray cross members each also include a plurality of the parallel recessed slots, whereby the tray cross members may be fitted into the recessed slots of the tray perimeter wall or another of the tray cross members.

The present invention is a device that can be moved between different bags, luggage pieces, backpacks, or the like, as desired. The present invention includes expandable organizer trays that are easily customizable to create varying sized sub-compartments within the tray. The present device is relatively inexpensive to manufacture and has relatively few parts, yet is still versatile in its uses. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," is "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
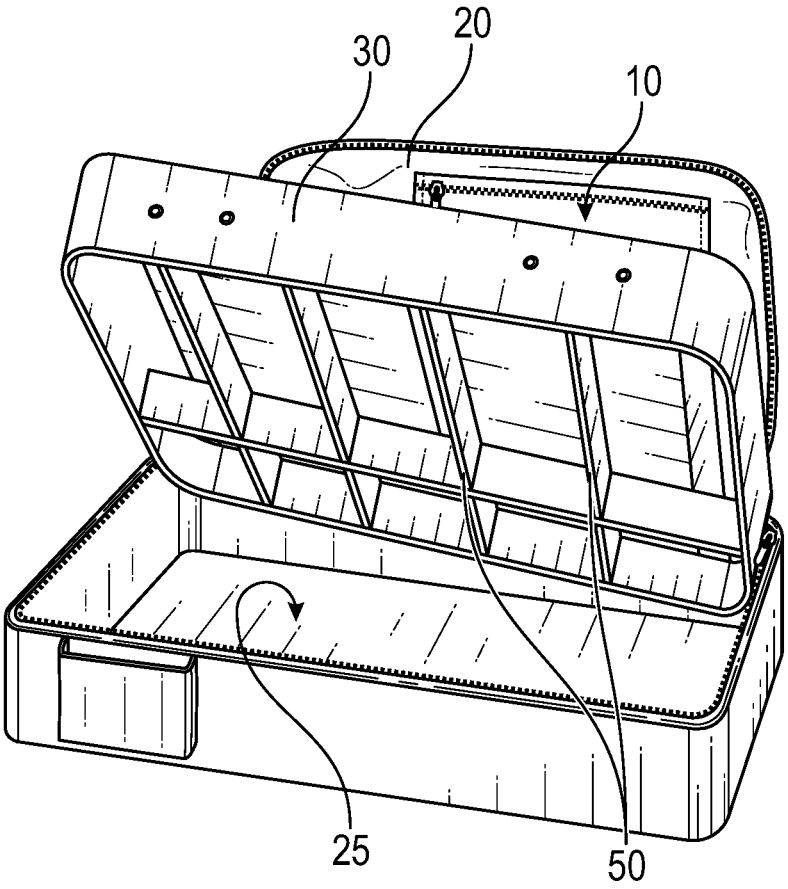
FIG. 1 is a perspective view of the invention as being fitted into a storage compartment of a case.
Figure 2:
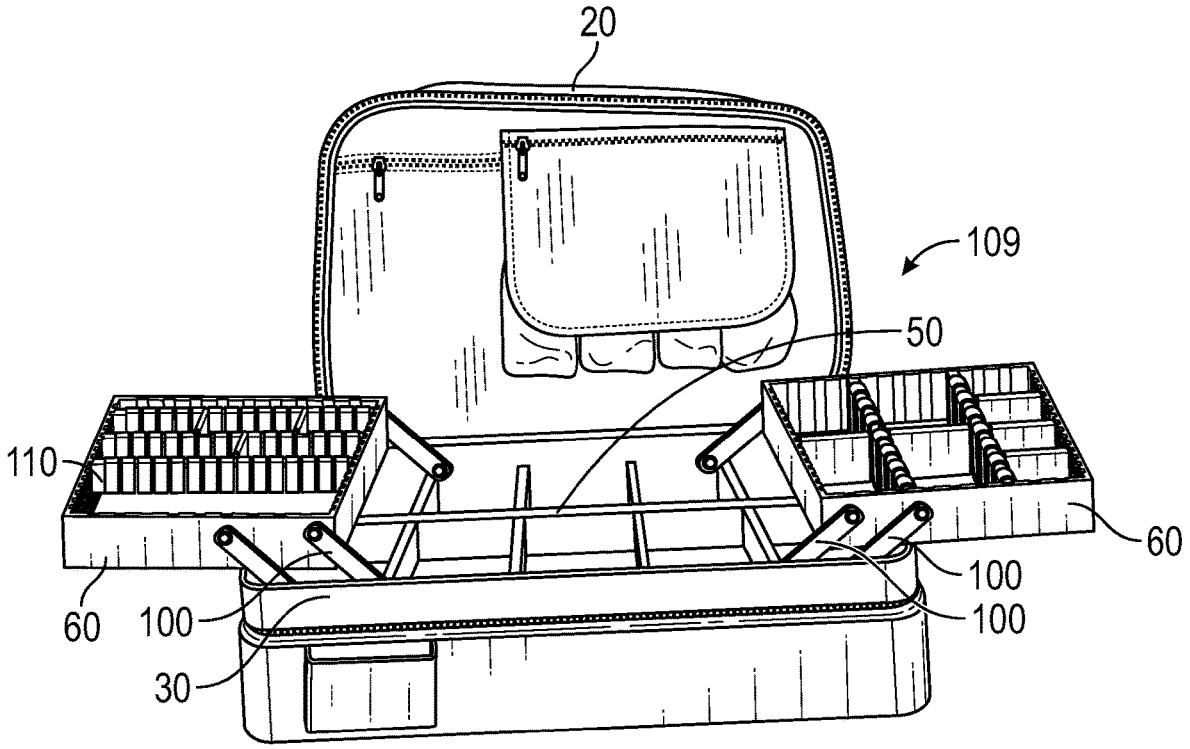
FIG. 2 is a front elevational view of the invention, illustrated with a pair of trays in a raised position.
Figure 3:
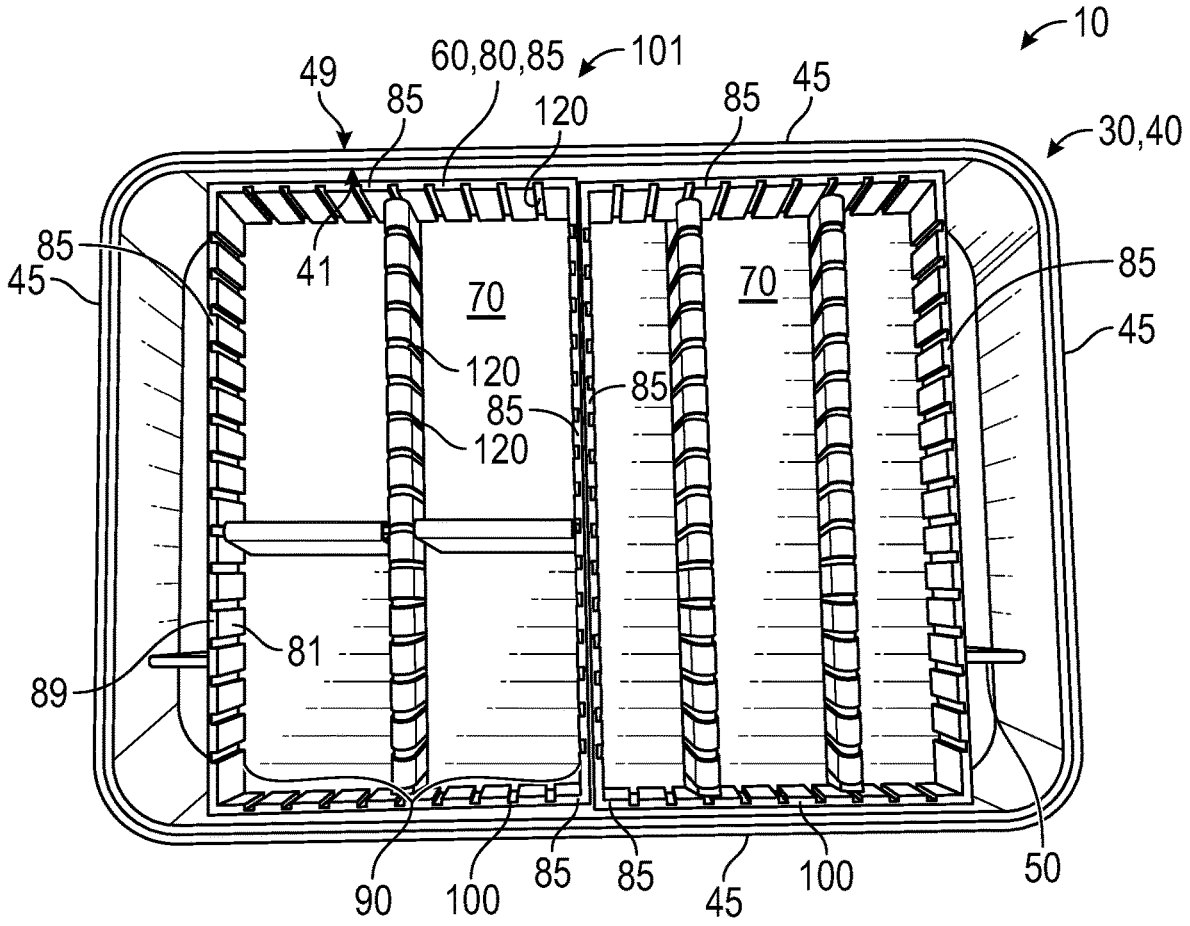
FIG. 3 is a top plan view of the invention, illustrated with the trays in a lowered position and within a boundary of a frame of the invention.

FIGS. 1-3 illustrate an organizing tray 10 for a case 20 that has a storage compartment 25. The case 20 may be a briefcase, a suitcase, or the like.

A frame 30 has a perimeter wall 40 that is comprised of at least four frame members 45, each of which have an inside surface 41 and an outside surface 49. At least two of the frame members 45 are parallel, and preferably the frame 30 takes a rectangular shape with two sets of parallel opposing frame members 45. The frame 30 is adapted to fit within the storage compartment 25 of the case 20, and can be made of various sizes corresponding with the size of any particular storage compartment 25 of the case 20. Preferably the perimeter wall 40 comprising the at least four frame members 45 is integrally formed with a plastic material that is either rigid or resilient. Preferably such a perimeter wall 40 includes rounded corners that facilitate insertion of the frame 30 into the case 20.

The frame 30 further includes one or more cross members 50 that extend between the inside surfaces 41 of at least two of the opposing frame members 45. Such cross members 50 are preferably selectively removable from slots (not shown) formed in the inside surface 41 of the frame members 45. Each of the one or more cross members 50 includes a top side 58 that extends between the inside surfaces 41 of the opposing frame members 45.

Figure 4:
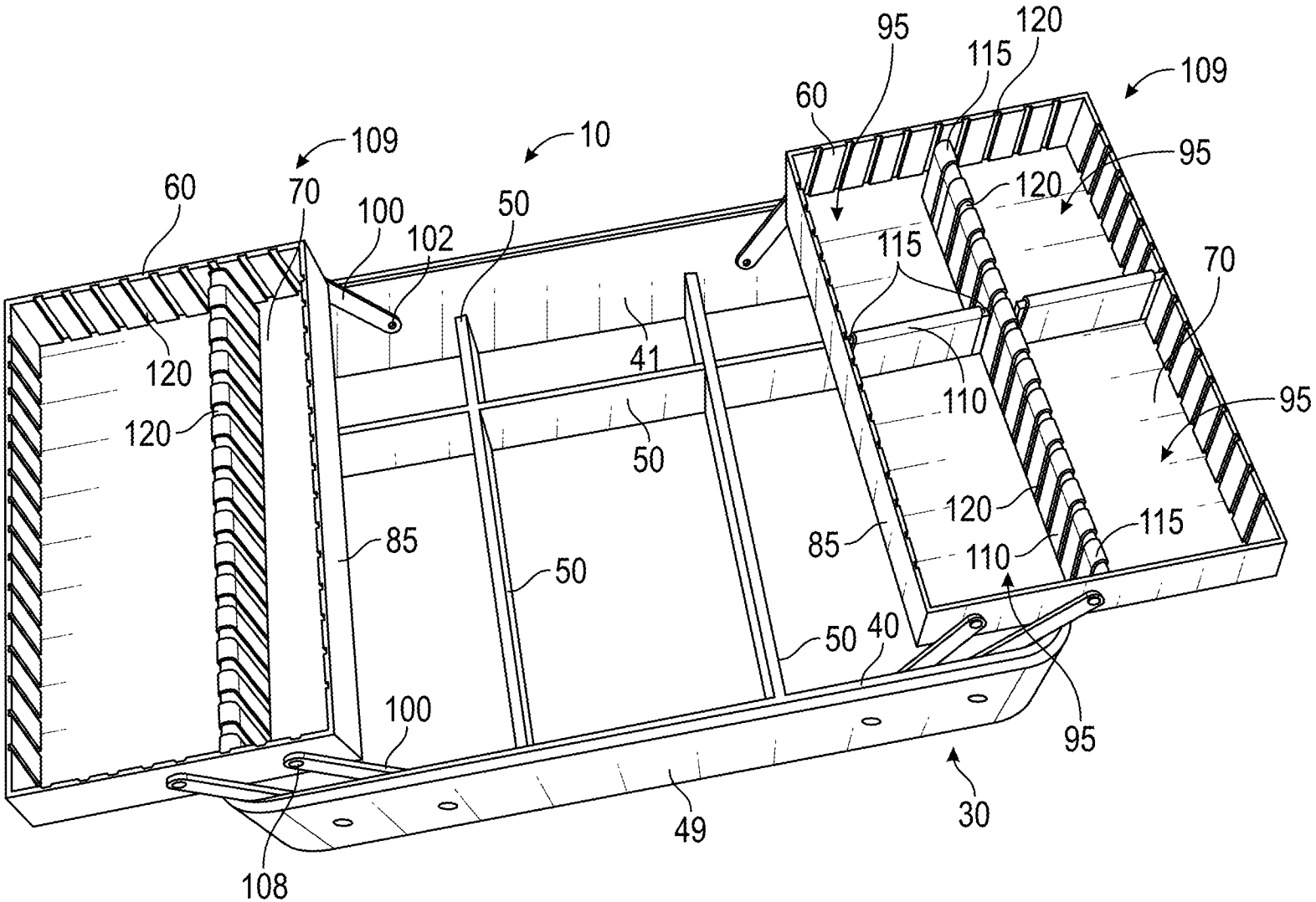
FIG. 4 is a top perspective view of the invention outside of the case and with the trays in the raised position.
Figure 5:
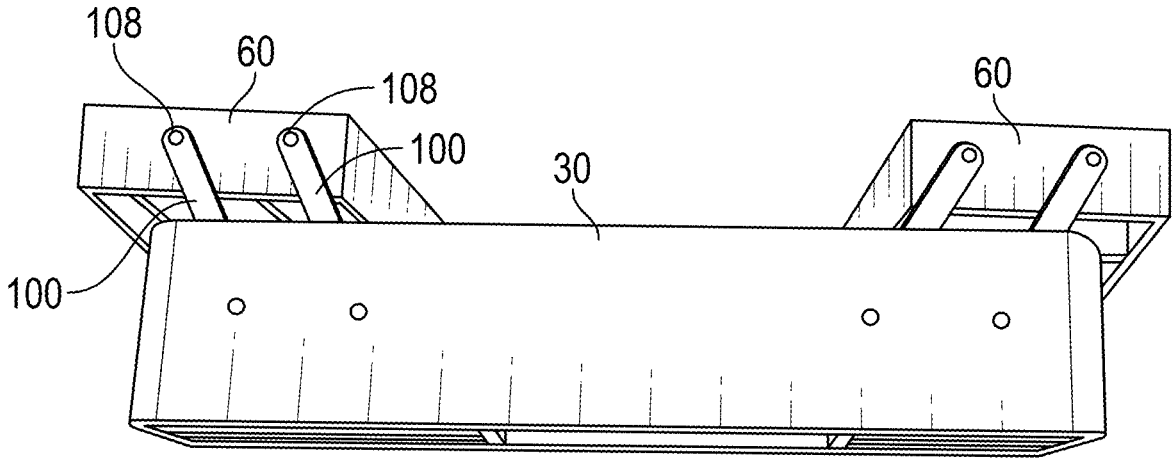
FIG. 5 is a side elevational view of the invention, illustrated with the trays in the raised position to expose extension members that support the trays on the frame.

As shown in FIGS. 1, 4, and 5, the frame 30 is bottomless between at least the one or more cross members 50 and the perimeter wall 40. This bottomless configuration allows the frame 30 to be placed within the storage compartment 25 of the case 20 such that the bottom wall of the storage compartment 25 is exposed between the cross members 50 and the perimeter wall 40, as illustrated in FIG. 1. As a result, when the frame 30 is disposed within the storage compartment 25, at least one frame sub-compartment is defined between at least the one or more cross members 50, the perimeter wall 40, and the exposed bottom wall of the storage compartment 25. FIG. 4 particularly demonstrates this bottomless design of the frame 30, showing how the cross members 50 and perimeter wall 40 provide structural support while leaving the area between them open.

One or more rectangular trays 60 each comprise a bottom wall 70 and a tray perimeter wall 80 that has at least four tray walls 85, each extending upwardly from the bottom wall 70. The tray walls 85 together with the bottom wall 70 define a large tray compartment 90 therein. Each tray wall 85 has an inside surface 81 and an outside surface 89.

Preferably each rectangular tray 60 is integrally formed from a rigid plastic material, such as through an injection molding process.

Two pairs of extension members 100 (FIGS. 4 and 5) for each tray 60 are included for moving the tray 60 from a lowered position 101 to a raised position 109 away from the frame 30. Each extension member 100 has a lower end 102 pivotally fixed with one of the at least two parallel frame members 45 of the frame 30, preferably at the inside surface 41 of the frame members 45. An upper end 108 of each extension member 100 is pivotally fixed with the outside surface 89 of one of the tray walls 85. The extension members 100 of each pair of extension members 100 are preferably parallel and laterally offset from each other. Preferably the tray 60, comprising the perimeter wall 80 having the at least four tray walls 85 and the bottom wall 70, is integrally formed with a rigid plastic material.

The trays 60, when in the lowered position 101, together are collapsed to within a projection of the perimeter wall 40 of the frame 30 (FIG. 3); that is to say, the trays 60 when in the lowered position 101 do not extend outwardly beyond the perimeter wall 40 of the frame 30 but instead rest above the cross members 50 of the frame 30. When in the lowered position 101, the extension members 100 of each pair of extension members remain parallel with each other and nearly or actually in mutual contact. Preferably each extension member 100 in each pair of extension members 100 is substantially identical in length. The upper end 108 and the lower end 102 of each extension member 100 are preferably pivotally attached to the tray 60 and the frame 30, respectively, with a rivet, screw and nut, or other mechanical fastener that allows the extension member 100 to rotate with respect to the tray 60 and the frame 30.

Preferably the organizing tray 10 further includes one or more tray cross members 110 each having two opposing ends 115. The inside surface 81 of the tray perimeter wall 80 of each tray 60 includes a plurality of parallel recessed slots 120. Each recessed slot 120 is adapted to receive one of the ends 115 of one of the tray cross members 110. As such, with the one or more tray cross members 110 fitted into two opposing recessed slots 120 of the tray perimeter wall 80, the large tray compartment 90 is divided into at least two sub-compartments 95.

Preferably one or more of the tray cross members 110 also include a plurality of the parallel recessed slots 120, whereby the tray cross members 110 may be fitted into the recessed slots 120 of the tray perimeter wall 80 or another of the tray cross members 110.

While a particular form of the invention has been illustrated and described, it will be apparent that various modifications can be made without departing from the spirit and scope of the invention. For example, while the drawings show a generally rectangular frame 30, the frame 30 could also take other shapes such as hexagonal, octagonal, trapezoidal, or the like. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the is inventor contemplates the various aspects of the invention in any number of claim forms. Accordingly, the inventor reserves the right to add additional claims after filing the application to pursue such additional claim forms for other aspects of the invention.

What is claimed is:

1. An organizing tray for a case having a storage compartment, the organizing tray comprising: a frame having a perimeter wall, the perimeter wall of the frame having a top side and a bottom side and comprised of at least four frame members each having an inside surface and an outside surface, at least two of the frame members being parallel, the frame adapted to fit within the storage compartment of the case, the frame further including one or more cross members each having a top side and a bottom side and extending between the inside surfaces of at least two of the opposing frame members and having a top side;

one or more rectangular trays each comprising a bottom wall, a tray perimeter wall having at least four tray walls each extending upwardly from the bottom wall and, together with the bottom wall, defining a tray compartment therein, each tray wall having an inside surface and an outside surface;

two pairs of extension members for each tray, each extension member having a lower end pivotally fixed with one of the at least two parallel frame members at a location above the top side of the one or more cross members of the frame, each extension member further having an upper end pivotally fixed with one of the tray walls, the tray when in a lowered position collapsed to within a projection of the perimeter wall of the frame such that an entirety of the tray and an entirety of each extension member pivotally fixed with the tray are disposed below the top side of the perimeter wall, the tray manually raisable from the lowered position into a raised position away from the frame; wherein when the frame is disposed within the storage compartment of the case, at least one frame sub-compartment is defined between at least the one or more cross members of the frame, the perimeter wall of the frame, and an exposed a bottom wall of the storage compartment of the case such that a top surface of the bottom wall of the storage compartment of the case is exposed and visible within the at least one frame sub-compartment.

2. The organizing tray of claim 1 wherein the lower end of each extension member is pivotally fixed with the inside surface of one of the at least two parallel frame members at the location above the top side of the one or more cross members of the frame, and wherein the upper end of each extension member is pivotally fixed with the outside surface of one of the tray walls.

3. The organizing tray of claim 1 wherein each extension member of each pair of extension members is laterally offset from the other extension member.

4. The organizing tray of claim 3 wherein each extension member of each pair of extension members has a substantially identical length.

5. The organizing tray of claim 1 further including one or more tray cross members each having two opposing ends, and wherein the inside surface of the tray perimeter wall of each tray includes a plurality of parallel recessed slots, each recessed slot adapted to receive one of the ends of one of the tray cross members, whereby with the one or more tray cross members fitted into two opposing recessed slots of the tray perimeter wall, the tray compartment is divided into at least two sub-compartments.

6. The organizing tray of claim 5 wherein one or more of the tray cross members each include a plurality of the parallel recessed slots, whereby the tray cross members may be fitted into the recessed slots of the tray perimeter wall or another of the tray cross members.

7. The organizing tray of claim 1 wherein the perimeter wall of the frame comprising the at least four frame members is integrally formed.

8. The organizing tray of claim 1 wherein the tray perimeter wall and the bottom wall of each tray are integrally formed.

9. The organizing tray of claim 1 wherein the one or more cross members of the frame are selectively removable from the frame.

10. The organizing tray of claim 1 wherein the tray is manually raisable into the raised position away from the frame when the frame is disposed within the storage compartment of the case.

11. The organizing tray of claim 1 wherein the one or more cross members of the frame include at least two cross members extending transversely with respect to one another.

12. The organizing tray of claim 1 wherein the frame is selectively removable from the storage compartment of the case.

13. An organizing tray for a case having a storage compartment, the storage compartment having at least a storage compartment bottom wall and a storage compartment perimeter wall extending upwardly from the storage compartment bottom wall, the organizing tray comprising:

a frame having a frame perimeter wall having a top side and a bottom side, the frame further having one or more cross members each having a top side and a bottom side and extending between an inside surface of the frame perimeter wall, the frame adapted to fit within the storage compartment of the case such that, when the frame is disposed within the storage compartment of the case, (i) an outside surface of the frame perimeter wall is substantially surrounded by the storage compartment perimeter wall, (ii) a top surface of the storage compartment bottom wall is exposed between at least the one or more cross members and the inside surface of the frame perimeter wall, and (iii) at least one frame sub-compartment is defined between at least the one or more cross members, the inside surface of the frame perimeter wall, and the exposed top surface of the storage compartment bottom wall;

one or more trays each comprising a tray bottom wall, a tray perimeter wall having at least four tray walls each extending upwardly from the tray bottom wall and, together with the tray bottom wall, defining a tray compartment therein, each tray wall having an inside surface and an outside surface;

two pairs of extension members for each tray, each extension member having a lower end pivotally fixed with the frame perimeter wall at a location above the top side of the one or more cross members of the frame, and an upper end pivotally fixed with one of the tray walls, the tray when in a lowered position collapsed to within a projection of the frame perimeter wall such that an entirety of the tray and an entirety of each extension member pivotally fixed with the tray are disposed below the top side of the perimeter wall, the tray manually raisable from the lowered position into a raised position away from the frame.

14. The organizing tray of claim 13 wherein the frame is selectively removable from the storage compartment of the case.

15. The organizing tray of claim 13 wherein the tray is manually raisable into the raised position away from the frame when the frame is disposed within the storage compartment of the case.

16. An organizing tray for a case having a storage compartment, the storage compartment having at least a storage compartment bottom wall and a storage compartment perimeter wall extending upwardly from the storage compartment bottom wall, the organizing tray comprising:

a frame having a frame perimeter wall, the frame perimeter wall having a top side and a bottom side and comprised of at least four frame members each having an inside surface and an outside surface, at least two of the frame members being parallel, the frame adapted to fit within the storage compartment of the case such that, when the frame is disposed within the storage compartment of the case, the frame perimeter wall is substantially surrounded by the storage compartment perimeter wall of the case, the frame further including one or more cross members each having a top side and a bottom side and extending between the inside surfaces of at least two of the opposing frame members of the frame perimeter wall;

one or more rectangular trays each comprising a bottom wall, a tray perimeter wall having at least four tray walls each extending upwardly from the bottom wall and, together with the bottom wall, defining a tray compartment therein, each tray wall having an inside surface and an outside surface;

two pairs of extension members for each tray, each extension member having a lower end pivotally fixed with one of the at least two parallel frame members of the frame perimeter wall, each extension member further having an upper end pivotally fixed with one of the tray walls, the tray when in a lowered position collapsed to within a projection of the frame perimeter wall such that an entirety of each extension member pivotally fixed with the tray is disposed below the top side of the frame perimeter wall, the tray manually raisable from the lowered position into a raised position away from the frame; wherein when the frame is disposed within the storage compartment of the case, at least one frame sub-compartment is defined between at least the one or more cross members of the frame, the perimeter wall of the frame, and an exposed a bottom wall of the storage compartment of the case such that a top surface of the bottom wall of the storage compartment of the case is exposed and visible within the at least one frame sub-compartment.

17. The organizing tray of claim 16 wherein the lower end of each extension member is pivotally fixed with the inside surface of one of the at least two parallel frame members of the frame perimeter wall at a location above the top side of the one or more cross members of the frame, and wherein the upper end of each extension member is pivotally fixed with the outside surface of one of the tray walls.

18. The organizing tray of claim 16 wherein when the frame is disposed within the storage compartment of the case, at least one frame sub-compartment is defined between at least the one or more cross members of the frame, the perimeter wall of the frame, and the storage compartment bottom wall of the case such that a top surface of the storage compartment bottom wall of the case is exposed and visible within the at least one frame sub-compartment.

19. The organizing tray of claim 16 wherein the frame is selectively removable from the storage compartment of the case.

* * * * *